United States Patent [19]

Hagemeister

[11] Patent Number: 4,666,136

[45] Date of Patent: May 19, 1987

[54] SPRING UNIT

[75] Inventor: Robert C. Hagemeister, Boston, Mass.

[73] Assignee: Webster Spring Co. Inc., Oxford, Mass.

[21] Appl. No.: 760,253

[22] Filed: Jul. 29, 1985

[51] Int. Cl.[4] ..... F16F 3/00; A47C 23/02

[52] U.S. Cl. ..... 267/103; 5/247; 5/255; 267/107

[58] Field of Search ..... 267/85, 87, 80, 100, 267/103, 142, 107, 476, 91, 104, 105; 5/256, 247, 255, 262, 267, 474, 246, 268, 476

[56] References Cited

U.S. PATENT DOCUMENTS

| | | | |
|---|---|---|---|
| 2,849,057 | 8/1958 | Neely | 267/107 |
| 4,004,304 | 1/1977 | Kane | 5/267 |
| 4,101,992 | 7/1978 | Levine et al. | 5/247 X |
| 4,339,834 | 7/1982 | Mizelle | 267/103 X |

*Primary Examiner*—Andres Kashnikow
*Assistant Examiner*—Robert J. Oberleitner
*Attorney, Agent, or Firm*—Robert T. Gammons

[57] ABSTRACT

A bent wire spring unit for interposition between a grid frame and base frame comprising upper and lower attaching elements and intervening spaced, parallel, oppositely-facing supports yieldably connecting the top and bottom attaching elements, said supports comprising first legs inclined upwardly in opposite directions from the bottom attaching elements at a predetermined angle, second legs inclined downwardly in opposite directions from the top attaching element at a sharper angle than the angle of inclination of the first legs relative to the bottom attaching element and spaced, parallel third legs connected at their upper and lower ends to the distal ends of the downwardly and upwardly-facing first and second legs, said third legs being concavely bent intermediate their ends in directions toward each other.

5 Claims, 6 Drawing Figures

SPRING UNIT

BACKGROUND OF THE INVENTION

In my U.S. Pat. No. 4,577,841, dated Mar. 25, 1986, there is shown and described a spring unit wherein there are top and bottom attaching elements connected to each other by a yieldable structure comprising spaced, parallel, vertical legs shorter in length than the distance between the top and bottom attaching elements and at the upper and lower ends inclined legs connecting the upper and lower ends to the attaching elements. Under extreme loads perpendicular to the attaching elements, the vertical legs tend to bow outwardly, which can lead to collapse. It is the purpose of this invention to structurally improve the aforesaid spring unit in such a way as to counteract the tendency for the vertical legs to collapse.

SUMMARY OF THE INVENTION

In accordance with the invention as herein disclosed, the spring units are structured for disposition between a supporting frame and a grid frame to yieldably support the latter relative to the support frame and comprise spaced top and bottom attaching elements structured to be attached to the grid frame and support frame, respectively, and vertically-disposed, spaced, parallel, oppositely-facing supports yieldably connecting the top and bottom attaching elements, said supports comprising first legs inclined upwardly in opposite directions from the bottom attaching elements at a predetermined angle, second legs inclined downwardly in opposite directions from the top attaching element at a greater angle than the angle of inclination of the first leg relative to the bottom attaching element and spaced, parallel third legs connected at their upper and lower ends to the distal end of the downwardly and upwardly-inclined first and second legs, said third legs being concavely bent intermediate their ends in directions toward each other.

The invention will now be described in greater detail with reference to the drawings, wherein.

Referring to FIGS. 1 to 6, a bent wire spring unit 10 is show disposed between the longitudinal and transverse wires 14—14 of a grid frame and a transverse support bar 16 of a base frame. A plurality of such spring units 10 are employed to support the grid frame for yield relative to the base frame.

Figure 1:
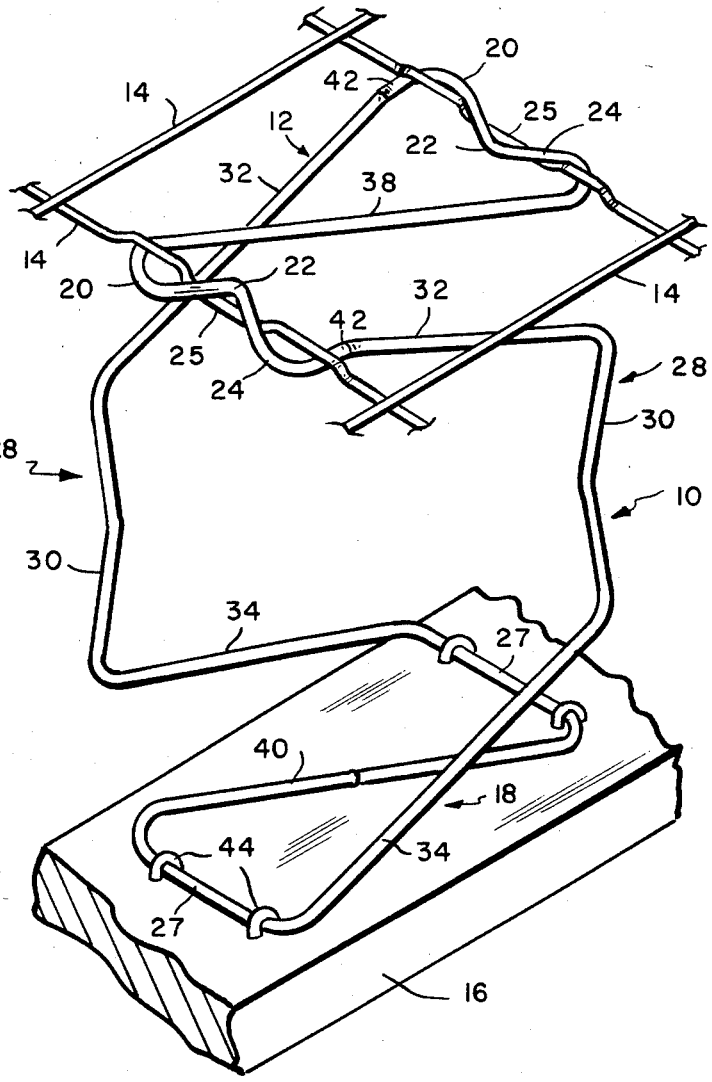
FIG. 1 is perspective view of a spring unit attached at its lower end to a base frame and at its upper end to a grid frame.
Figure 6:
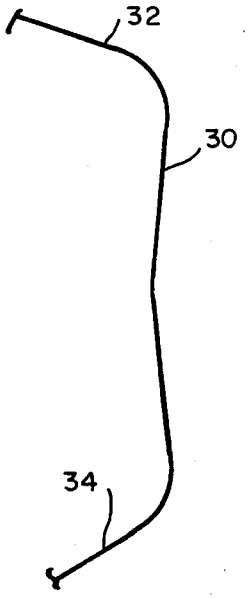
FIG. 6 is an enlarged view of a portion of one of the supports.
Figure 3:
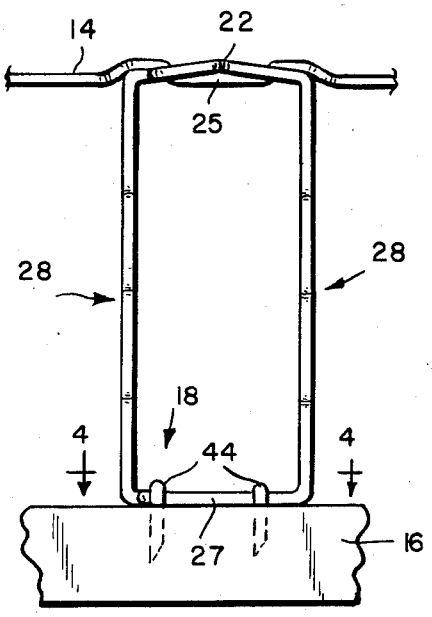
FIG. 3 is an elevation as seen from the front side of FIG. 1.

Each bent wire spring unit 10, FIG. 1, comprises an upper attaching element 12, a lower attaching element 18 and interposed yieldable supports 28—28 which permit yield of the upper and lower attaching elements relative to each other. More specifically, the upper attaching element 12 comprises spaced lengths of wire 20—20 connected at their opposite ends by a diagonal length of wire 38 and the lower attaching elements 18 comprise spaced, parallel lengths of wire 27—27 connected at their opposite ends by a diagonal length of wire 40. The yieldable supports 28—28 comprise spaced, parallel, generally C-shaped frames disposed in oppositely-facing relation to each other comprising substantially vertical lengths of wire 30—30, at the opposite ends of which there are diverging lengths of wire 32—32, 34—34, the upper and lower ends of which are connected, respectively, to one of the upper and lower lengths of the lengths of wire 20—20 and 27—27. The opposite ends of the lengths of wire 20—20 and 27—27 are connected to each other, respectively, by the diagonal lengths of wire 38 and 40. At the junctions of the upper ends of the wires 32—32 with the ends of the lengths of wire 20—20, there are horizontal lengths of wire 42—42 structured to prevent the grid wires 14—14 from sliding down the inclined lengths of wire 32—32. The lengths of wire 32—32 and 34—34 are at right angles to the lengths of wire 20—20 and 27—27 and the diagonal lengths of wire 38 and 40 are horizontal.

As shown in FIG. 1, the upper attaching elements 12—12 are attached to adjacent longitudinal grid wires 14—14 by deviations 22—22 formed in the spaced lengths of wire 20—20 which extend toward each other and which are interengaged with deviations 25—25 formed in the wires 14—14. The deviations 22—22 for securing the upper attaching elements to the wires 14—14 are like those shown in U.S. Pat. No. 4,004,304. The lower attaching elements 18—18 are attached to the support wire 16 by means of staples 44 driven into the support bar 16 over the lengths of wire 27—27.

Figure 2:
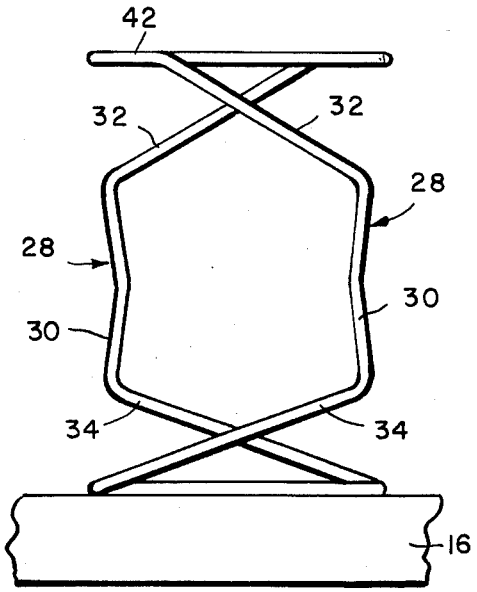
FIG. 2 is an elevation as seen from the right side of FIG. 1.
Figure 4:
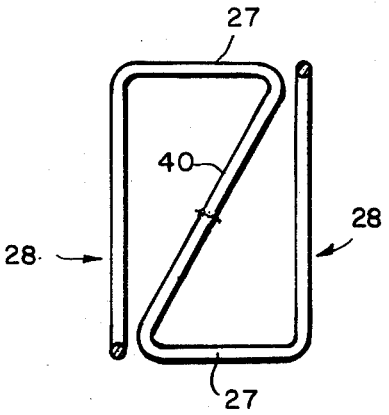
FIG. 4 is a horizontal section taken on the line 4—4 of FIG. 3.
Figure 5:
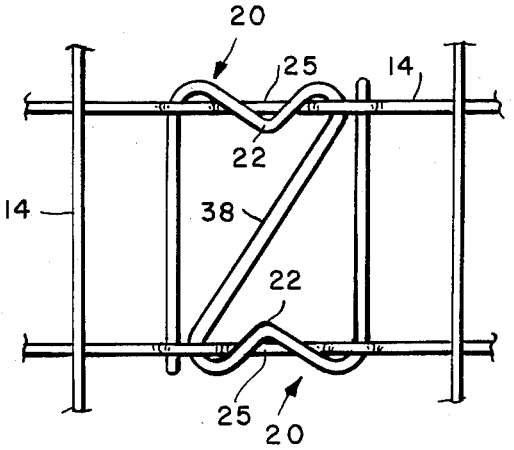
FIG. 5 is a plan view of FIG. 2.

In accordance with this invention, the vertical lengths of wire 30—30 are bent, FIGS. 1 and 2, intermediate their ends in directions toward each other, that is, toward the distal ends of the wires 32—32 and 34—34. This bending preferably takes the form of a obtuse angle of approximately 150 to 175 degrees, as shown in FIGS. 1 and 2. Optionally, the wires 30—30 may be bent on a radius so that they are arcuate between their upper and lower ends. In either form, the bending of the vertical wires toward each other counteracts the tendency for the wires to collapse by pressure applied to the upper and lower ends of the unit through the inclined legs 32—32, the effect of which is to rotate the upper and lower ends of the vertical lengths relative to each other in a direction outwardly, that is, in opposite directions away from each other which, if excessive, would bring about collapse of the unit.

In addition to the provision of the bent vertical length of wire, a further feature resides in disposing the lower length of wire 34—34 at a lesser angle of inclination relative to the bottom attaching element than the angle for inclination of the upper length of wire 32—32 relative to the upper attaching element. This, together with the fact that the lower lengths of wire 34—34 are longer than the upper lengths of wire 32—32, provides for a softer yield at the lower ends of the spring units which, in turn, reduces the tendency for the attaching element 18 at the lower end of the spring unit to pull away from the supporting frame when under load.

The bent wire spring units are symmetrical in planes at right angles to each other and provide resistance in bending and torsion to displacement and, hence, controlled yield.

The spring assembly embodying the spring unit as described comprises a rectangular base frame having longitudinally-spaced, parallel, transverse bars as of wood to which the lower ends of the spring units are stapled and a rectangular grid frame comprised of a border wire and lonitudinally and transverse crossing wires to which the upper ends of the spring units are attached. The spring units are distributed in transversely and longitudinally-spaced relation.

It should be understood that the present disclosure is for the purpose of illustration only and includes all modifications or improvements which fall within the scope of the appended claims.

What is claimed is:

1. A spring unit for disposition between a supporting frame and a grid frame to yieldably support the latter relative to the supporting frame comprising spaced top and bottom attaching means structured to be attached to the grid and support frames, respectively, and vertically-disposed, spaced, parallel supports yieldably connecting the top and bottom attaching means, said supports comprising first legs connected at one end to the bottom attaching means and inclined upwardly in opposite directions from the bottom attaching means at a predetermined angle, second legs connected at one end to the too attaching means and inclined downwardly in opposite directions from the top attaching means at a greater angle than the angles of inclination of the first legs relative to the bottom attaching means and spaced, parallel third legs connected at their upper and lower ends to the distal ends of the downwardly and upwardly-inclined first and second legs, said third legs being bent intermediate their ends in directions toward said one end of the first and second legs and said first and second legs being disposed in a common plane.

2. A bent wire spring unit for disposition between a base frame and a grid frame comprising vertically-spaced, parallel top and bottom attaching means and vertically-disposed, spaced, parallel supports connecting the top and bottom attaching means such as to permit the top and bottom attaching means to move relative to each other in response to pressure applied perpendicularly to the top attaching means, said supports each comprising a vertical length of wire of lesser length than the distance between the top and bottom attaching means and upper and lower lengths of wire inclined with respect to the vertical lengths of wire connecting the upper and lower ends of the vertical elements to the upper and lower attaching means, characterized in that the upper lengths of wire are inclined at a steeper angle than the lower lengths of wire and that the vertical lengths of wire are bent in the plane of the upper and lower lengths of wire in the direction of the distal ends of the upper and lower lengths of wire.

3. A bent wire spring unit in accordance with claim 2 wherein the bent wire defines a obtuse angle.

4. A bent wire spring unit in accordance with claim 2 wherein the bent wire defines an arc.

5. A spring assembly comprising a base frame embodying a support bar, a grid frame embodying longitudinal and transverse crossing wires and a spring unit connecting the wires of the grid frame to the bar of the base frame, said spring unit comprising top to bottom attaching means structured to be attached to the wires of the grid frame and the bar of the base frame, respectively, said spring unit comprising first legs inclined upwardly in opposite directions from the bottom attaching means at a predetermined angle, second legs inclined downwardly in opposite directions from the top attaching means at a greater angle than the angle of inclinaton of the first legs relative to the bottom attaching means, said first and second legs being disposed in a common plane and speced, parallel third legs connected at their upper and lower ends to the distal ends of the downwardly and upwardly-inclined first and second legs, said third legs being bent intermediate their ends in directions toward the upper and lower ends of the first and second legs.

* * * * *

UNITED STATES PATENT AND TRADEMARK OFFICE

CERTIFICATE OF CORRECTION

PATENT NO. : 4,666,136

DATED : May 19, 1987

INVENTOR(S) : Robert C. Hagemeister

It is certified that error appears in the above—identified patent and that said Letters Patent is hereby corrected as shown below:

Column 3, line 22, change "too" to --top--

Column 4, line 32, change "speced" to --spaced--

Signed and Sealed this

Eighteenth Day of August, 1987

*Attest:*

DONALD J. QUIGG

*Attesting Officer*

*Commissioner of Patents and Trademarks*